United States Patent [19]

Kleykamp

[11] 4,334,625

[45] Jun. 15, 1982

[54] WEAR MEMBER FOR RAILWAY VEHICLE

[75] Inventor: Donald L. Kleykamp, Dayton, Ohio

[73] Assignee: Dayco Corporation, Dayton, Ohio

[21] Appl. No.: 162,864

[22] Filed: Jun. 25, 1980

[51] Int. Cl.[3] ..... B61G 7/10; B61G 5/00; B61G 9/20

[52] U.S. Cl. ..... 213/61

[58] Field of Search ..... 213/61; 105/225; 308/3 R, 238

[56] References Cited

U.S. PATENT DOCUMENTS

| | | | |
|---|---|---|---|
| 4,120,404 | 10/1978 | Chierici et al. | 213/61 |
| 4,238,039 | 12/1980 | Cooper et al. | 213/61 |
| 4,261,472 | 4/1981 | Moore et al. | 213/61 |
| 4,264,015 | 4/1981 | Mathieu | 213/61 |

FOREIGN PATENT DOCUMENTS

| | | | |
|---|---|---|---|
| 2017612 | 10/1979 | United Kingdom | 213/61 |

*Primary Examiner*—Richard A. Bertsch
*Attorney, Agent, or Firm*—Joseph V. Tassone

[57] ABSTRACT

A wear member for a railway vehicle and method of making same are provided wherein such wear member is comprised of a metal support having a substantially planar sheet portion which has a continuous supporting surface and ultra high molecular weight polymeric material disposed against the supporting surface on a common interface with such metal support and polymeric material being attached and interlocked together as a unitary structure by cooperating formed means in the two components at the interface and free of additional attaching components.

12 Claims, 11 Drawing Figures

WEAR MEMBER FOR RAILWAY VEHICLE

BACKGROUND OF THE INVENTION

1. Field of the Invention

This invention relates to a wear member for use between a pair of relatively movable components of a railway vehicle.

2. Prior Art Statement

It is known in the railway industry to provide a wear member between relatively movable components of a railway vehicle wherein such wear member is supported by one of the components and protects such components against excessive wear. In order to provide such a wear member which has optimum structural integrity and a wear surface which has the desired antifriction properties, wear members have been proposed which use an ultra high molecular weight (UHMW) polymeric material, such as polyethylene, for the desired antifriction properties and a metallic supporting material supporting the polymeric throughout its area for structural strength. However, it is well known in the art that it is very difficult to bond UHMW polymeric material directly against metallic material whereby various techniques have been proposed for attaching these two components and basically all of these techniques employ additional attaching means or components in the form of additional mechanical components and/or additional attaching materials interposed between the UHMW polymeric material and the metallic material.

For example, it has been proposed in U.S. Pat. No. 4,238,039 to provide additional attaching means between polymeric material and a metal support of a railway vehicle wear member in the form of a metal structure fixed to the metal support for the purpose of attaching the two components together.

It has also been proposed in U.S. Pat. No. 3,554,618 to provide a wear member in the form of pedestal liner which has an insert or plastic wear plate which is unsupported except at its peripheral edges.

It has also been proposed in U.S. Pat. No. 4,264,015 to provide a wear member which has a main body made of a polymeric material which is basically unsupported in the central part thereof and has a reinforcing structure embedded therein and which has parts of the polymeric material disposed in embracing relation around opposed side edge surface portions of support means for the main body.

However, it would be desirable to provide a wear member for relatively movable components of a railway vehicle comprised basically of UHMW polymeric material which has its entire area supported by a metallic supporting material and it would be desirable to provide such wear member at minimum cost while using the overall structural advantages and characteristic of these two materials.

SUMMARY

It is a feature of this invention to provide a wear member for relatively movable components of a railway vehicle wherein such wear member is comprised of a metal support having a substantially planar sheet portion which has a continuous supporting surface and an ultra high molecular weight polymeric material disposed against the supporting surface on a common interface with the metal support and polymeric material being self-attached and interlocked together as a unitary structure by cooperating integral means thereof at the interface free of additional attaching components.

Another feature of this invention is to provide a wear member of the character mentioned wherein the metal support and polymeric material are self-attached and interlocked at said interface by formed means therein.

Another feature of this invention is to provide a wear member of the character mentioned in which the cooperating formed means comprises molded means of the polymeric material.

Another feature of this invention is to provide a wear member of the character mentioned in which the cooperating formed means comprises an opening in the substantially planar sheet portion of the support.

Another feature of this invention is to provide a wear member of the character mentioned in which the polymeric material extends through the opening as an integral column and has an outer portion provided with an integral head whereby such column and head serve as an integral polymeric rivet.

Another feature of this invention is to provide a wear member of the character mentioned in which the cooperating formed means comprises indentation means in the planar metal sheet portion.

Another feature of this invention is to provide a wear member of the character mentioned in which the cooperating formed means comprises an integral locking tab formed from a portion of the planar metal sheet portion which is disposed transverse to such planar sheet portion and wherein such tab is enveloped by the polymeric material.

Another feature of this invention is to provide a wear member of the character mentioned which also comprises a reinforcing structure embedded within the polymeric material for the purpose of providing reinforcement for such polymeric material and preventing cold flow thereof.

Another feature of this invention is to provide an improved method of making a wear member of the character mentioned for use between relatively movable components of a railway vehicle.

Therefore, it is an object of this invention to provide an improved wear member, and method of making same, having one or more of the novel features set forth above or hereinafter shown or described.

Other details, features, uses, objects, and advantages of this invention will become apparent from the embodiments thereof presented in the following specification, claims and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 1:
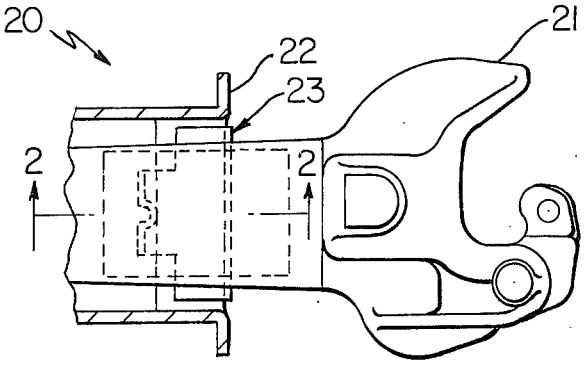
FIG. 1 is a fragmentary top plan view of an end portion of a freight car showing a coupler and a coupler carrier thereof with a wear member of this invention, in the form of a coupler carrier wear member, disposed therebetween.
Figure 2:
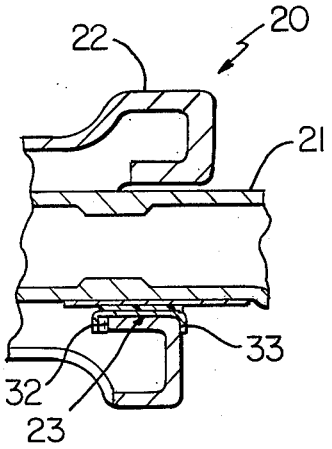
FIG. 2 is a fragmentary cross-sectional view taken essentially on the line 2—2 of FIG. 1.
Figure 3:
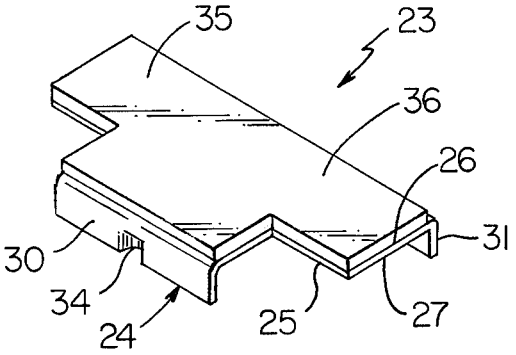
FIG. 3 is a perspective view of the coupler carrier wear member of FIG. 1.

Reference is made to FIGS. 1 and 2 of the drawings which illustrate a fragmentary portion of one end of a railway vehicle 20 and such vehicle has a coupler assembly 21 and a coupler carrier 22. The coupler assembly 21 and coupler carrier 22 are relatively movable and will be considered as the relatively movable components or members of the railway vehicle in this example of the invention. A wear member, designated generally by the reference numeral 23, is also shown in FIG. 3 and is provided and supported by one of the components and in this example such wear member 23 is supported by the coupler carrier 22. The wear member 23 protects the components 21 and 22 and in particular the shank portion of the coupler assembly 21 and the adjoining portion of the coupler carrier 22 from excessive wear during relative movement thereof.

Figure 5:
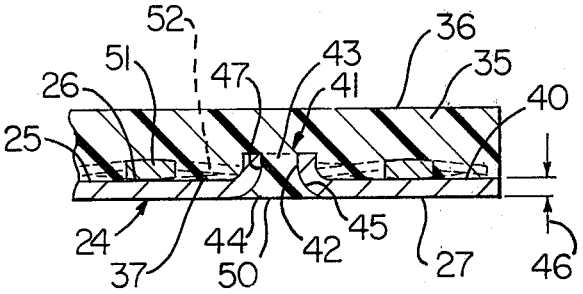
FIG. 5 is an enlarged fragmentary cross-sectional view taken essentially on the line 5—5 of FIG. 4.
Figure 4:
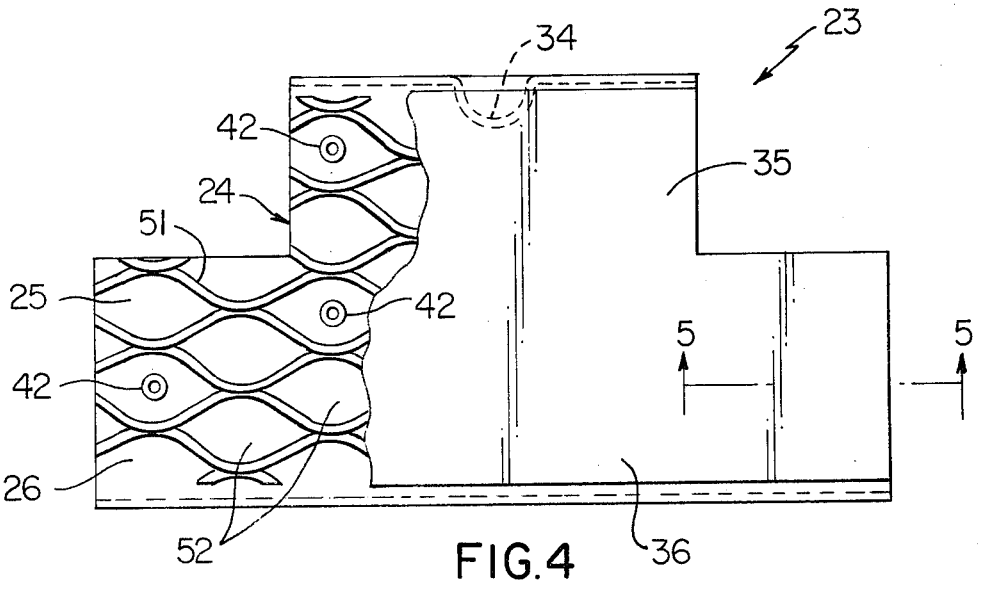
FIG. 4 is an enlarged plan view of the coupler carrier wear member of FIG. 3 with a fragmentary portion thereof broken away.

As seen in FIGS. 3–5 the wear member 23 comprises a metal support 24 which has a substantially planar sheet-like or sheet portion 25 which has a continuous supporting surface 26 and a surface 27 opposite the supporting surface 26. The substantially planar sheet portion 25 of the support 24 in this example is substantially T-shaped and the support 24 has a pair of depending flanges 30 and 31 defined as an integral part of and extending substantially perpendicularly from opposite side edges of the sheet portion 25. The flanges 30 and 31 are particularly adapted to engage associated surfaces 32 and 33 respectively of the coupler carrier 22, as shown in FIG. 2, to hold the wear member in position between the assembly 21 and carrier 22. The flange 30 has an integral locating projection 34 which is adapted to be received in an associated recess in the surface 32 for the purpose of locating the wear member 23 on a surface of coupler carrier 22 in a precise manner.

The wear member 23 comprises polymeric material which is preferably in the form of ultra high molecular weight (UHMW) polymeric material 35 and the material 35 has an antifriction surface 36 which is engageable by the coupler assembly 21. The polymeric material 35 has an inside surface 37 which engages the continuous supporting surface 26 on a common interface 40.

The wear member 23 also has means attaching the polymeric material 35 to the support 24 and supporting same against the continuous supporting surface 26; and, in accordance with the teachings of this invention such attaching is in the form of cooperating formed means in the support and in the polymeric material at the interface 40 which attach and interlock components 24 and 35 together free of additional components and such formed means is designated generally by the reference numeral 41 in FIG. 5. Stated otherwise the UHMW polymeric material 35 and metal support 24 are basically self held by cooperating formed means therein.

The cooperating formed means 41 in the wear member 23 comprises molded means in the polymeric material 35; and, as will be readily apparent from FIG. 5, polymeric material is molded around integral portions of the metal support 24 as will now be described.

The formed means 41 comprises a formed opening in the support 24 which is designated generally by the reference numeral 42 and an integral column 43 of the polymeric material 35 extends through the opening 42 with the integral column 43 having an outer portion provided with an integral head 44. The head 44 is larger in cross-sectional area than the corresponding cross-sectional area of the opening 42 and such head 44 has an inner portion 45 which engages a part of the opposite surface 27 of the metal support 24 and enables the integral column and head to attach and interlock the support 24 and polymeric material 35 together in a high-strength manner.

The above description has proceeded with the description of a single or only one cooperating formed means 41 in support 24 and polymeric material 35 which is illustrated in FIG. 5; however, as seen in FIG. 4, it will be appreciated that such cooperating formed means 41 in the support 24 and polymeric material 35 may comprise any desired plurality of openings 42 in the planar sheet portion 25 of the metal support 24 and a corresponding plurality of associated molded means in the polymeric material 35. The plurality of openings 42 provided in such planar sheet portion 25 may be disposed in any desired pattern.

Referring again to FIG. 5, the substantially planar sheet portion 25 of the support column 24 has its continuous supporting surface 26 and its opposite surface 27 provided as substantially planar surfaces and surfaces 26–27 are disposed in parallel relation and define the wall thickness 46 of the sheet portion 25 therebetween. It will also be seen that each opening 42 is defined by an integral tubular formation 47 in the sheet portion 25 with the tubular formation 47 having a thickness which is substantially uniform and equal to the wall thickness 46.

Each tubular formation 47 has a base portion which is larger in diameter than the diameter of its terminal portion thereby defining an outwardly flaring portion of the opening 42. The previously mentioned integral head 44 of the integral column 43 of polymeric material 35 is disposed in the outwardly flaring portion of the opening 42; and, the head 44 has an exposed outside surface 50 which is coplanar with the substantially planar opposite surface 27 of the metal support 24.

The wear member 23 also comprises a reinforcing structure, preferably in the form of an expanded metal structure 51, embedded within the polymeric material 35. The reinforcing structure is disposed between the supporting surface 26 and the antifriction wear surface 36. The reinforcing structure 51 has openings 52 therein and as will be readily apparent from FIG. 5 of the drawings the polymeric material 35 surrounds the reinforcing structure while extending through the openings 52 whereby structure 51 provides reinforcement for the polymeric material 35 while preventing cold flow thereof once such polymeric material is under external loads.

The expanded metal structure 51 may be a regular expanded metal structure having openings 52 therein which are of roughly diamond-shaped outline or such expanded metal structure may be of the flattened variety. However, regardless of which type of structure the openings 52 define at least 50% of the overall area of a planar portion of the structure 51; and, in this example such openings define substantially more than 50% of such overall area. The expanded metal structure 51 may be fastened to the metal support 24 at a few suitable locations to facilitate processing and any suitable fastening means may be provided for this purpose.

Other exemplary embodiments of the wear member of this invention are illustrated in FIGS. 6–8 and 9–11 of the drawings. The wear members of FIGS. 6–8 and 9 through 11 are very similar to the wear member 23; therefore, such wear members will be designated by the reference numerals 23A and 23B respectively and representative component parts of each wear member which are similar to corresponding parts of the wear member 23 will be designated in the drawings by the same reference numeral as in the wear member 23 (whether or not such representative parts are mentioned in the specification) followed by the letter designation A or B. Only those component parts of the wear member 23A and 23B which are different from corresponding parts of the wear member 23 will be designated by a new reference numeral also followed by the associated letter designation either A or B and described in more detail.

Figure 8:
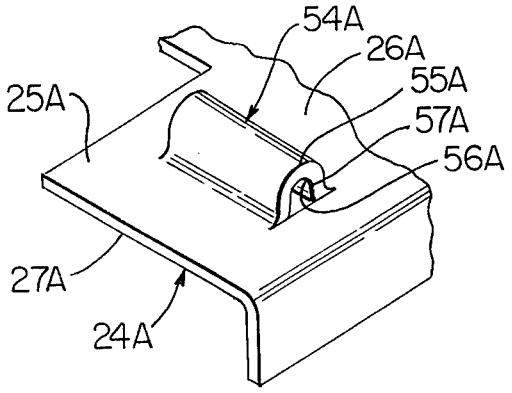
FIG. 8 is a fragmentary perspective view illustrating an end portion of a metal support comprising the wear member of FIG. 6.
Figure 7:
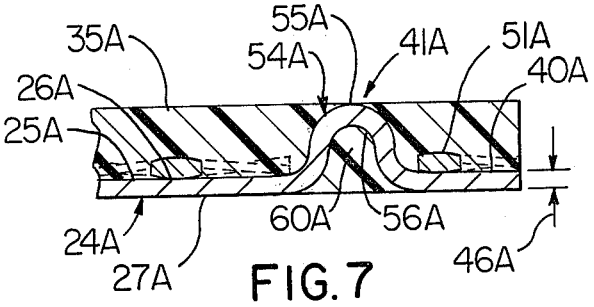
FIG. 7 is an enlarged cross-sectional view taken essentially on the line 7—7 of FIG. 6 and drawn to an enlarged scale.
Figure 6:
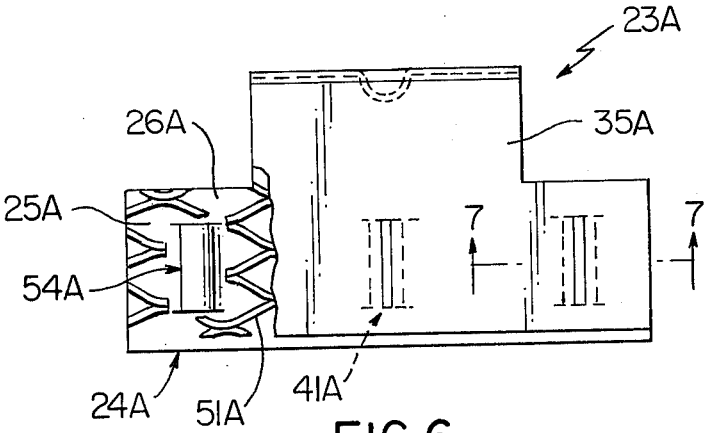
FIG. 6 is a view similar to FIG. 4 drawn to a reduced scale and illustrating another exemplary embodiment of a wear member of this invention also shown as a coupler carrier wear member.

The wear member 23A of FIGS. 6–8 also comprises a metal support 24A which has a sheet-like portion 25A and an ultra high molecular weight (UHMW) polymeric material 35A which are held together by attaching means comprising cooperating formed means 41A in a support 24A and in a polymeric material 35A at the interface 40A of the two components 24A and 35A whereby such formed means 41A attach and interlock such components together free of additional components. The substantially planar sheet portion 25A also has a substantially planar supporting surface 26A and a substantially planar opposite surface 27A disposed in parallel relation and defining the wall thickness 46A of the sheet portion 25A therebetween.

The cooperating formed means 41A comprises a substantially semicylindrical indentation 54A in the sheet portion 25A which has a convex surface 55A which is convex from the supporting surface 26A toward the polymeric material and a concave surface 56A which is concave outwardly relative to the opposite surface 27A. The semicylindrical indentation 54A in the sheet portion 25A defines a pair of openings 57A in the sheet portion 25A at the opposite ends of the indentation and each of the openings 57A has a substantially semicircular cross-sectional configuration. As will be readily apparent from FIG. 7 of the drawings a portion 60A of the polymeric material 35A is received against the concave surface 56A of the indentation 54A and has a substantially semicylindrical solid configuration which extends through the openings 57A as an integral structure and blends smoothly with the remaining polymeric material 35A of the wear member 23A whereby the semicylindrical solid portion 60A of polymeric material interlocks the polymeric material 35A to the metal support 24A. It will be seen that the indentation 54A has a uniform thickness throughout which is substantially equal to the wall thickness 46A of the metal support 24A.

As in the case of the wear member 23 the detailed description of member 23A has been presented with a description of a single indentation 54A and the polymeric material 35A associated therewith representing the description of cooperating formed means 41A; however, it will be appreciated that in the usual application a plurality of indentations 54A are provided in the metal support 24A (as shown in FIG. 6) and such indentations are disposed in a symmetrical pattern and cooperate with the polymeric material 35A to define the cooperating formed means 41A. Thus, the polymeric material 35A and metal support 24A are self-held together free of additional attaching means.

The wear member 23A may also be provided with an expanded metal reinforcing structure 51A which has openings 52A therein. The structure 51A is provided for the same purposes as the structure 51 of the wear member 23.

Figure 11:
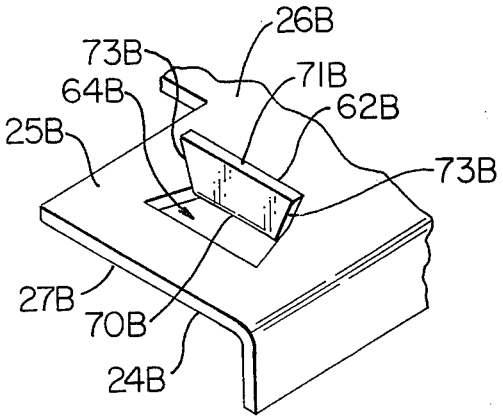
FIG. 11 is a view similar to FIG. 8 and illustrating an end portion of a metal support comprising the wear member of FIG. 9.
Figure 10:
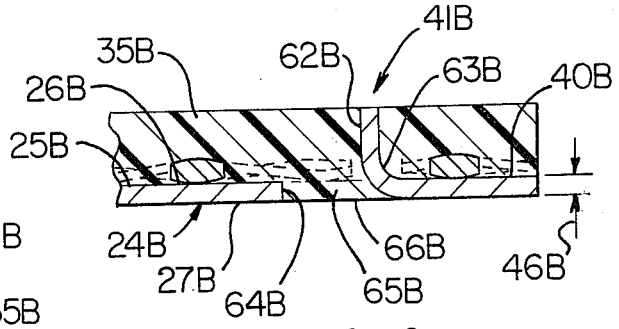
FIG. 10 is a cross-sectional view taken essentially on the line 10—10 of FIG. 9 and drawn to an enlarged scale.
Figure 9:
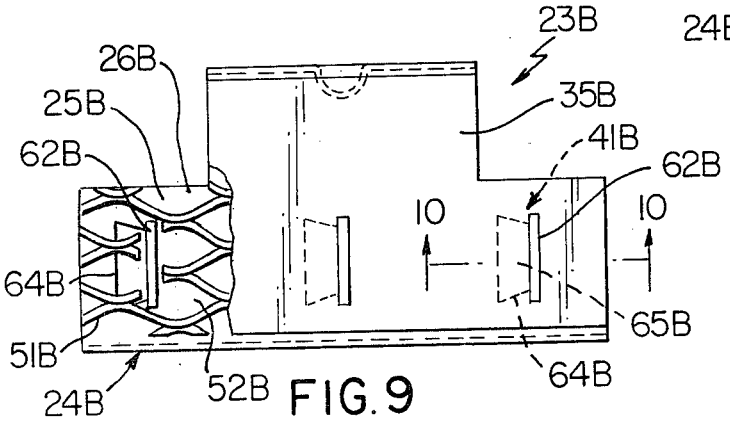
FIG. 9 is a view similar to FIG. 6 illustrating another exemplary embodiment of a wear member of this invention also in the form of a coupler carrier wear member.

The wear member 23B of FIGS. 9–11 also has metal support 24B and UHMW polymeric material 35B which are attached together with attaching means in the form of cooperating formed means 41B in the support 24B and in the polymeric material 35B with such formed means being at an interface 40B between components 24B and 35B. The formed means 41B serve to attach and interlock the components 24B and 35B together free of additional components. The wear member 24B also has a substantially planar sheet portion 25B which has the supporting surface 26B and opposite surface 27B provided as substantially planar surfaces and are disposed in parallel relation thereby defining the wall thickness 46B of the sheet portion 25B therebetween.

The cooperating formed means comprises an integral tab 62B in the sheet portion 25B defined by a displaced part of the sheet portion 25B and disposed transverse the supporting surface 26B thereof. In this example, the integral tab 62B is disposed perpendicular to the surface 26B and basically attached thereto on a generous arc 63B. The displaced part of the sheet portion 25B which defines the integral tab 62B defines an opening 64B in the sheet portion 25B which has an outline which corresponds to the outline of the tab 62B. The tab 62B is embedded within the polymeric material 35B and it will be seen that such polymeric material 35B has what will be referred to as a wedge 65B thereof extending through the opening 63B. The wedge 65B has an exposed surface 66B which is disposed substantially coplanar with the opposite surface 27B.

The tab 62B has a substantially trapezoidal peripheral outline which is defined by a short parallel side 70B and a longer parallel side 71B. The base of the tab is defined by the short parallel side 70B and is fastened to the sheet portion 25B on the integral arcuate portion 63B while the longer parallel side 71B of the tab 62B is disposed remote from the supporting surface 26B thereby defining at least one outwardly flaring surface at a side edge of the tab 62B. In this example, the trapezoidal tab 62B has both of its nonparallel sides, each designated by the same reference numeral 73B, defined as outwardly diverging or flaring surfaces whereby once the polymeric material is formed in position the surfaces 73B serve as locking surfaces.

As in the case of the wear members 23 and 23A the detailed description of the member 23B has been presented with a description of a single tab 62B and polymeric material 35B associated therewith representing the description of cooperating formed means 41B; however, as mentioned in the other embodiments of the wear member of this invention, in the usual application, a plurality of tabs 62B is provided in the metal support 24B (as shown in FIG. 9) and such tabs are disposed in a symmetrical pattern and cooperate with the polymeric material 35B to define the cooperating formed means 41B. As described for the wear members 23 and 23A, the polymeric material 35B and the metallic support 24B of the wear member 23B are self-held together free of additional means. The wear member 23B is also shown provided with an expanded metal reinforcing structure 51B which has openings 52B therein and structure 51B is provided for the same purposes as the structures 51 and 51A of the wear members 23 and 23A respectively.

Each wear member 23, 23A and 23B of this invention is preferably made utilizing certain basic method steps now to be presented. In particular, each wear member is made employing the steps of providing a metal support having a substantially planar sheet portion which has a continuous supporting surface and a surface opposite the supporting surface and molding in position an ultra high molecular weight polymeric material which has an antifriction surface which is engageable by an associated component of a railway vehicle and an inside surface which engages the supporting surface on a common interface. The metal support and UHMW polymeric material are attached by the step of attaching the polymeric material to the support and supporting same against the supporting surface with the improvement in the attaching step being achieved employing the step of forming cooperating means in the support and in the polymeric material at the interface by forming means in the metal support and thereafter forming cooperating means in the polymeric material with the forming of the means in the polymeric material being achieved during the molding step. The cooperating formed means serve to attach and interlock the support and polymeric material together free of additional components.

In one embodiment of the method used to define wear member 23 the step of forming cooperating formed means comprises defining an opening 42 in the planar sheet portion of the support and molding an integral column of polymeric material which extends through the opening and has an outer portion provided with an integral head which is larger in cross-sectional area than the corresponding cross-sectional area of the opening. As previously described the head has an inner portion which engage a part of the opposite surface of the planar sheet portion whereby the integral column and head of polymeric material serve to attach and interlock the support and polymeric material together. The step of defining the opening may comprise defining an integral tubular formation in the planar sheet portion in a manner as described previously.

It will also be appreciated that in another embodiment of the method used to define wear member 23A the step of forming cooperating formed means comprises defining a substantially semicylindrical indentation 54A in the planar sheet portion of the support having a configuration as described previously for such indentation and molding a portion of the polymeric material against the concave surface thereof as described previously.

Finally, in connection with the wear member 23B it will be appreciated that the step of forming cooperating formed means comprises defining an integral tab 62B in the sheet portion of the support by displacing a part of the sheet portion transverse to the main body thereof and molding a portion of the polymeric material around the tab embedding same therein.

The polymeric material 35, 35A, 35B may be suitably formed in position employing any technique known in the art and such polymeric material may be provided in powder, flake, pellet, or similar solid form and supported in position by a suitable mold device which is capable of being heated and with the mold device defining the shape of the polymeric material on its metal support, whether 24, 24A, or 24B. The entire assembly consisting of the metal support and mold device may be supported in position on an associated standard press and subjected to controlled temperatures and pressures to thereby define the polymeric material and upon cooling of the polymeric material the completed structure in each instance is essentially as illustrated in the drawings. As is known in the art, polymeric material may also be provided in molten form from a conventional extruder and introduced into a suitable mold device using known techniques whereby upon cooling and solidification thereof the configuration of the polymeric material for its associated wear member is defined.

The polymeric material 35, 35A and 35B may be any suitable UHMW polymeric material known in the art and preferably has a molecular weight of at least two million. The preferred material is polyethylene which has a molecular weight within the range of four to six million. The preferred technique for determining molecular weight is referred to as the intrinsic viscosity test and is widely used in the United States.

While present exemplary embodiments of this invention, and methods of practicing the same, have been illustrated and described, it will be recognized that this invention may be otherwise variously embodied and practiced within the scope of the following claims.

What is claimed is:

1. In a wear member for a railway vehicle wherein said vehicle comprises a pair of relatively movable components and said wear member is supported by one of said components and protects said components from wear during relative movement thereof; said wear member comprising; a metal support having a substantially planar sheet portion which has a continuous supporting surface and a surface opposite said supporting surface; an ultra high molecular weight polymeric material having an antifriction wear surface engageable by the other of said components and an inside surface engaging said supporting surface on a common interface; and means attaching said polymeric material to said support and supporting same against said supporting surface; the improvement in said attaching means comprising cooperating formed means in said sheet portion of said support and in said polymeric material at said interface which attach and interlock same together free of additional components, said cooperating formed means in said sheet portion comprising at least one displaced part of said sheet portion defining opening means therein and said cooperating formed means in said polymeric material comprising an integral mass of said polymeric material extending through said opening means, said polymeric material serving to embed said displaced part therein, and said integral displaced part embedded in said polymeric material cooperating with said integral mass to provide said attaching and interlocking of said support and polymeric material free of said additional components.

2. A wear member as set forth in claim 1 and further comprising a reinforcing structure embedded within said polymeric material, said reinforcing structure being disposed between said supporting surface and said wear surface.

3. A wear member as set forth in claim 2 in which said reinforcing structure has openings therein, and said polymeric material surrounds said reinforcing structure while extending through said openings and thereby provides reinforcement for said polymeric material while preventing cold flow thereof.

4. A wear member as set forth in claim 3 in which said reinforcing structure is a metal structure.

5. A wear member as set forth in claim 4 in which said metal structure is an expanded metal structure having openings therein of roughly diamond shaped outline with said openings defining at least 50% of the overall area of a planar portion of said expanded metal structure.

6. In a wear member for a railway vehicle wherein said vehicle comprises a pair of relatively movable components and said wear member is supported by one of said components and protects said components from wear during relative movement thereof; said wear member comprising; a metal support having a substantially planar sheet portion which has a continuous supporting surface and a surface opposite said supporting surface; an ultra high molecular weight polymeric material having an antifriction wear surface engageable by the other of said components and an inside surface engaging said supporting surface on a common interface; and means attaching said polymeric material to said support and supporting same against said supporting surface; the improvement in said attaching means comprising cooperating formed means in said support and in said polymeric material at said interface which attach and interlock same together free of additional components; said cooperating formed means comprising molded means of said polymeric material; and, said cooperating formed means further comprising an opening in said support, an integral column in said polymeric material extending through said opening and having an outer portion provided with an integral head which is larger in cross-sectional area than the corresponding cross-sectional area of said opening, and said head having an inner portion engaging a part of said opposite surface enabling said integral column and head to attach and interlock said support and polymeric material together; and said substantially planar sheet portion having said supporting surface and said opposite surface provided as substantially planar surfaces and disposed in parallel relation thereby defining the wall thickness of said sheet portion therebetween, said opening being defined by an integral tubular formation in said sheet portion, said tubular formation having a thickness which is substantially uniform and equal to said wall thickness, said tubular formation also having a base portion which has a diameter which is larger than the diameter of its terminal portion thereby defining an outwardly flaring portion in said opening, and said head being disposed in said outwardly flaring portion.

7. A wear member as set forth in claim 6 in which said head has an exposed outside surface which is coplanar with said substantially planar opposite surface.

8. In a wear member for a railway vehicle wherein said vehicle comprises a pair of relatively movable components and said wear member is supported by one of said components and protects said components from wear during relative movement thereof; said wear member comprising; a metal support having a substantially planar sheet portion which has a continuous supporting surface and a surface opposite said supporting surface; an ultra high molecular weight polymeric material having an antifriction wear surface engageable by the other of said components and an inside surface engaging said supporting surface on a common interface; and means attaching said polymeric material to said support and supporting same against said supporting surface; the improvement in said attaching means comprising cooperating formed means in said support and in said polymeric material at said interface which attach and interlock same together free of additional components; said substantially planar sheet portion having said supporting surface and said opposite surface provided as substantially planar surfaces and disposed in parallel relation thereby defining a wall thickness of said sheet portion therebetween; and said cooperating formed means comprising, a substantially semicylindrical indentation in said sheet portion which has a convex surface which is convex from said supporting surface toward said polymeric material and a concave surface which is concave outwardly relative to said opposite surface, said identation defining a pair of openings in said sheet portion at the opposite ends of said indentation with each of said openings having a substantially semicircular cross-sectional configuration, and a portion of said polymeric material is received against said concave surface and has a substantially semicylindrical solid configuration which extends through said openings as an integral structure and blends smoothly with the remaining polymeric material of said wear member.

9. A wear member as set forth in claim 8 in which said indentation has a uniform thickness throughout which is substantially equal to said wall thickness.

10. In a wear member for a railway vehicle wherein said vehicle comprises a pair of relatively movable components and said wear member is supported by one of said components and protects said components from wear during relative movement thereof; said wear member comprising; a metal support having a substantially planar sheet portion which has a continuous supporting surface and a surface opposite said supporting surface; an ultra high molecular weight polymeric material having an antifriction wear surface engageable by the other of said components and an inside surface engaging said supporting surface on a common interface; and means attaching said polymeric material to said support and supporting same against said supporting surface; the improvement in said attaching means comprising cooperating formed means in said support and in said polymeric material at said interface which attach and interlock same together free of additional components; said substantially planar sheet portion having said supporting surface and said opposite surface provided as substantially planar surfaces and disposed in parallel relation thereby defining a wall thickness of said sheet portion therebetween; and said cooperating formed means comprising, an integral tab in said sheet portion defined by a part of said sheet portion displaced transverse said supporting surface and defining an opening in said sheet portion of corresponding outline, said tab having a base hingedly fastened to said sheet portion with said tab being embedded within said polymeric material, and said polymeric material having a wedge thereof extending through said opening.

11. A wear member as set forth in claim 10 in which said wedge has an exposed surface disposed substantially coplanar with said opposite surface.

12. A wear member as set forth in claim 11 in which said tab has a substantially trapezoidal peripheral outline defined by a short parallel side which defines said hingedly fastened base, said tab has a longer parallel side which is disposed remote from said supporting surface thereby defining at least one outwardly flaring surface at a side edge of said tab, and said outwardly flaring surface is engaged by said polymeric material and serves to lock said support and polymeric material together as a unitary structure.

* * * * *